US006014105A

United States Patent [19]

Davis et al.

[11] Patent Number: 6,014,105

[45] Date of Patent: Jan. 11, 2000

[54] MICROSTRIP ANTENNA HAVING AN INTERNAL FEED

[75] Inventors: Albert F. Davis, Ventura; Scott R. Kujiraoka, Camarillo, both of Calif.

[73] Assignee: The United States of America as Represented by the Secretary of the Navy, Washington, D.C.

[21] Appl. No.: 09/233,231

[22] Filed: Jan. 19, 1999

[51] Int. Cl.[7] ..... H01Q 1/38

[52] U.S. Cl. ..... 343/700 MS; 343/767

[58] Field of Search ..... 343/700 MS, 846, 343/848, 809, 767

[56] References Cited

U.S. PATENT DOCUMENTS 4,766,440 8/1988 Gegan ..... 343/700 MS
4,771,291 9/1988 Lo et al. ..... 343/700 MS

*Primary Examiner*—Don Wong
*Assistant Examiner*—Tan Ho
*Attorney, Agent, or Firm*—David Kalmbaugh

[57] ABSTRACT

A one half wavelength microstrip antenna which has its structural feed point positioned in a location which is different from the location of its electrical feed point. The microstrip antenna comprises a disc-shaped dielectric which has a radiating patch mounted on its upper surface and a ground plane affixed to its lower surface. Attached to the bottom surface of the ground plane is a threaded coaxial cable connecter for receiving a coaxial cable which supplies a microwave signal to the microstrip antenna. Extending vertically upward from the connector is a center contact pin which electrically couples the antenna element to the coaxial cable. The antenna element includes a V-shaped element of etched copper which has its rounded bottom portion positioned adjacent the center contact pin. The area enclosed by V-shaped element of etched copper forms a 50 ohm transmission line which electrically connects the center contact pin to the antenna feed point of the microstrip antenna which allows for the transmission of the microwave signal from the center contact pin to the antenna feed point.

11 Claims, 2 Drawing Sheets

MICROSTRIP ANTENNA HAVING AN INTERNAL FEED

BACKGROUND OF THE INVENTION

1. Field of the Invention

The present invention relates generally to microstrip antennas. More specifically, the present invention relates to a microstrip antenna having an internal electrical feed point which allows the antenna to be mounted in a confined environment.

2. Description of the Prior Art

In the context of this application, a microstrip-type antenna is one that is generally well known in the prior art as comprising a conductive ground plane or reference surface over which a reasonantly dimensioned conductive radiator "patch" is disposed.

In the past the radiating element or radiator "patch" of microstrip antennas have been generally edge fed or probe fed. For example, a probe fed microstrip antenna is described in U.S. Pat. No. 4,613,868 to Michael A. Weiss wherein a dual slotted microstrip antenna structure has an impedance matching slot and centrally located feed points with each feed point being a probe type feed point.

An edge fed microstrip antenna array is described in U.S. Pat. No. 5,017,931 for use at millimeter wave frequencies which radiates and receives a broadside beam of energy in which a first symmetric edge-fed array has its radiating elements physically interleaved with the radiating elements of a center-fed array.

Occasionally a microstrip antenna will have a mounting requirement which necessitates a different feed point from the desired or designed electrical feed point which is typically at an edge of the radiating "patch". For example, an antenna housing may have the antenna's feed connector constrained at a location in the housing that does not coincide with the designed electrical feed point for the antenna's radiating "patch". This requires a modification to the antenna's radiating "patch" design to accommodate a difference in location between the microstrip antenna's structural feed point and its designed electrical feed point while maintaining the antenna's microwave signal and radiation pattern.

SUMMARY OF THE INVENTION

The present invention overcomes some of the disadvantages of the prior art including those mentioned above in that it comprises a highly reliable and effective one half wavelength microstrip antenna which has its structural feed point positioned in a location which is different from the location of its electrical feed point.

The microstrip antenna comprises a disc-shaped dielectric which has a radiating patch mounted on its upper surface and a ground plane affixed to its lower surface. Attached to the bottom surface of the ground plane is a threaded coaxial cable connecter for receiving a coaxial cable which supplies a microwave signal to the microstrip antenna. Extending vertically upward from the connector is a center contact pin which electrically couples the antenna element to the coaxial cable.

The antenna element includes a V-shaped element of etched copper which has its rounded bottom positioned adjacent the center contact pin. The area enclosed by V-shaped element of etched copper forms a 50 ohm transmission line. The 50 ohm transmission line electrically connects the center contact pin to the antenna feed point of the microstrip antenna allowing for the transmission of the microwave signal from the center contact pin to the antenna feed point.

DETAILED DESCRIPTION OF THE PREFERRED EMBODIMENT

Figure 1:
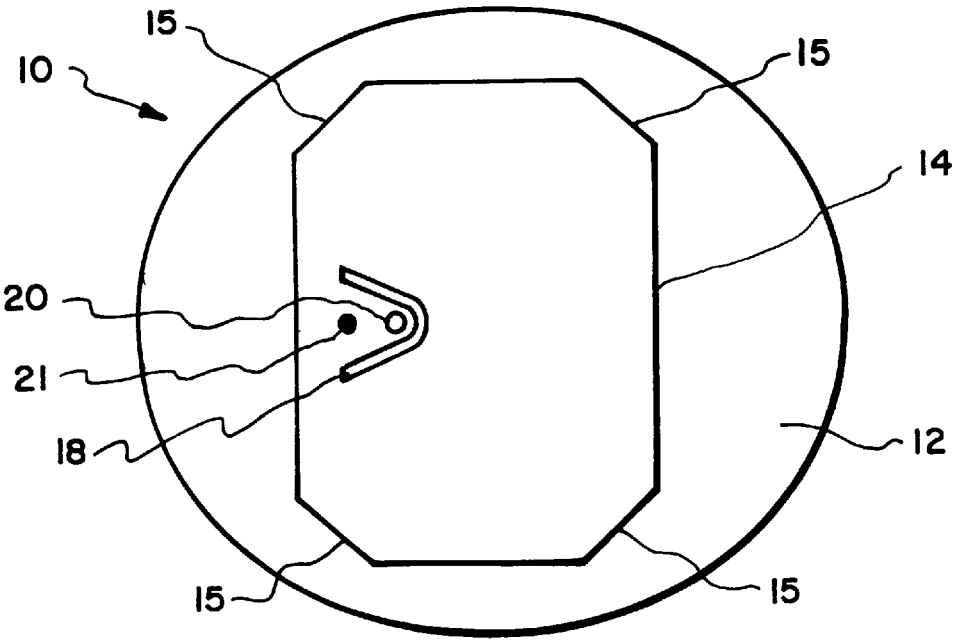
FIG. 1 is a plane view of a one half wavelength microstrip antenna which has its electrical and structural feed points positioned in different locations.

Referring to FIG. 1, there is shown a microstrip antenna, designated generally by the reference numeral 10, which has an operating frequency of 1775 MHz. Microstrip antenna 10 is a one half wavelength microstrip antenna.

Figure 2:
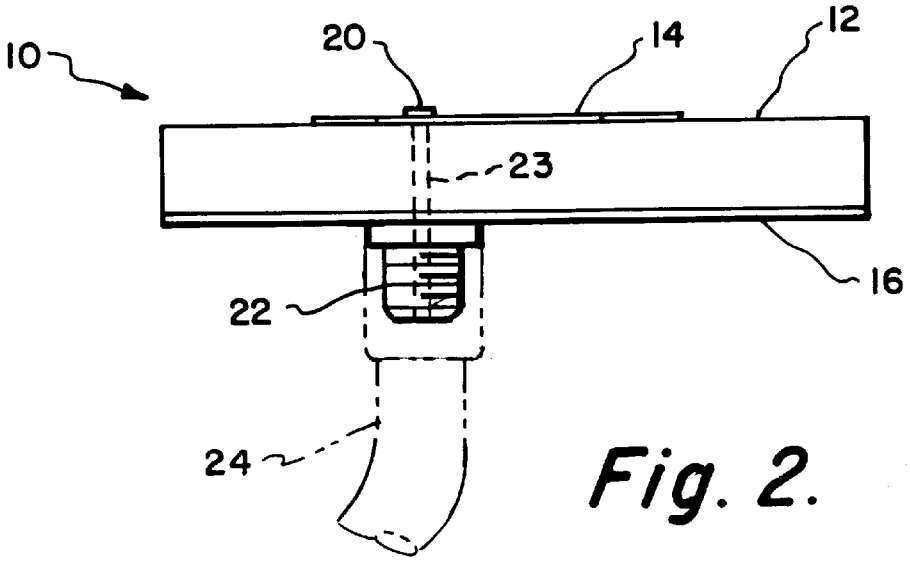
FIG. 2 is a side view of the one half wavelength microstrip antenna of FIG. 1.

Referring to FIGS. 1 and 2, microstrip antenna 10 comprises a disc-shaped dielectric 12 which has a radiating patch or antenna element 14 mounted on its upper surface and a ground plane 16 affixed to its lower or bottom surface. Ground plane 16 and disc-shaped dielectric 12 have the same identical shape as shown in FIG. 1.

Antenna element 14 which is generally rectangular in shape has angled corners 15 and is fabricated from copper. Ground plane 16 is also fabricated from copper and is circular in shape with a diameter equal to the diameter of dielectric 12.

The dielectric used in the preferred embodiment of the present invention is Teflon type material RT/duroid 6006 commercially available from the Microwave Materials Division of Rogers Corporation of Chandler, Ariz.

Referring to FIG. 2, there is attached to the bottom surface of ground plane a threaded coaxial cable connecter 22. Threaded coaxial cable connecter 22 is adapted to receive a coaxial cable 24 (illustrated in phantom) which supplies a microwave signal to microstrip antenna 10. Extending vertically upward from connector 22 through an opening 23 within dielectric 12 is a center contact pin 20. As depicted in FIG. 1, center contact pin 20 is electrical connected to antenna element 14 allowing for transmission of the microwave signal from coaxial cable 24 to antenna element 14 via center contact pin 20. Center contact pin 20 forms the structural feed point for microstrip antenna 10.

Figure 3:
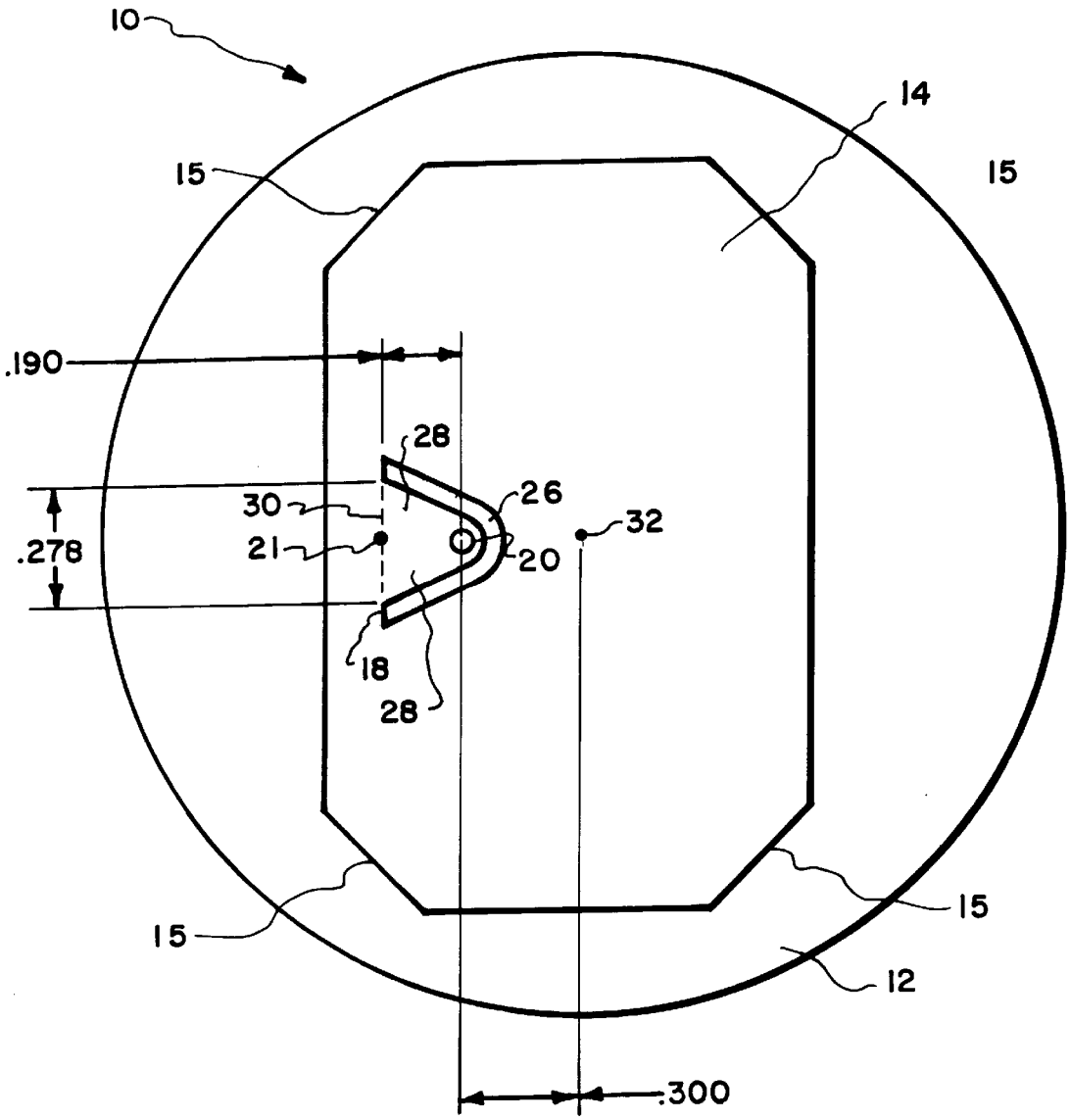
FIG. 3 is another plane view of the one half wavelength microstrip antenna of FIG. 1.

Referring to FIGS. 1 and 3, antenna element 14 includes a generally V-shaped piece or element of etched copper 18. V-shaped element of etched copper 18 has a rounded bottom 26 which has its inner edge positioned adjacent center contact pin 20. The area enclosed by V-shaped element of etched copper 26 and dashed line 30 forms a 50 ohm transmission line 28 which electrically connects center contact pin 20 to the electrical or antenna feed point 21 for microstrip antenna 10. Transmission line 28 allows for transmission of the microwave signal from center contact pin 20 to antenna feed point 21 for radiation of the signal by antenna element 14.

Referring to FIG. 3, it should be noted that the distance between the center point 32 of disc-shaped dielectric 12 and center contact pin 20 is 0.300 inches, while the distance between pin 20 and antenna feed point 21 is 0.190 inches. In addition, as depicted in FIG. 3, the width of V-shaped element of etched copper 18 is 0.278 inches.

The dimensions illustrated in FIG. 3 and V-shaped element of etched copper 18 are required to form the 50 ohm transmission line 28 which connects center contact pin 20 to antenna feed point 21. It should be understood, however, that the dimensions for a microstrip antenna which has, for example, a different operating frequency from the microstrip antenna of the present invention may be substantially different.

It should also be noted that a commercially available Windows based electromagnetic simulation software package "Ensemble" developed by Ansoft Corporation of Pittsburg, Pa. was used to assist in the design and simulation of the one half wavelength microstrip antenna which constitutes the preferred embodiment of the present invention.

From the foregoing, it may readily be seen that the present invention comprises a new, unique and exceedingly useful microstrip antenna having an internal feed point which constitutes a considerable improvement over the known prior art. Obviously, many modifications and variations of the present invention are possible in light of the above teachings. It is, therefore to be understood that within the scope of the appended claims that the invention may be practiced otherwise than as specifically described.

What is claimed:

1. A one half wavelength microstrip antenna having an internal feed comprising:

a disc shaped dielectric substrate;

a ground plane affixed to a bottom surface of said disc shaped dielectric substrate;

a substantially rectangular shaped copper radiating element mounted on a top surface of said disc shaped dielectric substrate;

a contact pin electrically connected to said copper radiating element, said contact pin being positioned a predetermined distance from a center point of said copper radiating element, said contact pin extending downward from said copper radiating element through said dielectric substrate to a bottom surface of said ground plane;

a coaxial cable connecter attached to the bottom surface of said ground plane, said coaxial cable connector being electrically connected to said contact pin; and a V-shaped element of etched copper located within said copper radiating element, said V-shaped element of etched copper including a rounded bottom, the rounded bottom of said V-shaped element of etched copper having an inner edge positioned adjacent said contact pin;

a portion of said copper radiating element located within said V-shaped element of etched copper forming a transmission line, said transmission line electrically connecting said contact pin to an antenna feed point for said copper radiating element of said microstrip antenna.

2. The microstrip antenna of claim 1 wherein said predetermined distance said contact pin is positioned from the center point of said copper radiating element is approximately 0.300 inches.

3. The microstrip antenna of claim 1 wherein said antenna feed point is positioned approximately 0.190 inches from said contact pin.

4. The microstrip antenna of claim 1 wherein the width of said V-shaped element of etched copper is approximately 0.278 inches.

5. The microstrip antenna of claim 1 wherein said coaxial cable connecter comprises a threaded coaxial cable connecter adapted to receive a coaxial cable.

6. The microstrip antenna of claim 1 wherein the operating frequency of the copper radiating element of said microstrip antenna is approximately 1775 megahertz.

7. A one half wavelength microstrip antenna having an internal feed comprising:

a disc shaped dielectric substrate;

a ground plane affixed to a bottom surface of said disc shaped dielectric substrate;

a substantially rectangular shaped copper radiating element mounted on a top surface of said disc shaped dielectric substrate;

a contact pin electrically connected to said copper radiating element, said contact pin being positioned a predetermined distance from a center point of said copper radiating element, said contact pin extending downward from said copper radiating element through said dielectric substrate to a bottom surface of said ground plane;

a threaded coaxial cable connecter attached to the bottom surface of said ground plane, said threaded coaxial cable connecter being electrically connected to said contact pin; and a V-shaped element of etched copper located within said copper radiating element, said V-shaped element of etched copper including a rounded bottom, the rounded bottom of said V-shaped element of etched copper having an inner edge positioned adjacent said contact pin;

a portion of said copper radiating element located within said V-shaped element of etched copper forming a fifty ohm transmission line, said fifty ohm transmission line electrically connecting said contact pin to an antenna feed point for said copper radiating element of said microstrip antenna.

8. The microstrip antenna of claim 7 wherein said predetermined distance said contact pin is positioned from the center point of said copper radiating element is approximately 0.300 inches.

9. The microstrip antenna of claim 7 wherein said antenna feed point is positioned approximately 0.190 inches from said contact pin.

10. The microstrip antenna of claim 7 wherein the width of said V-shaped element of etched copper is approximately 0.278 inches.

11. The microstrip antenna of claim 7 wherein the operating frequency of the copper radiating element of said microstrip antenna is approximately 1775 megahertz.

* * * * *